US008353588B2

(12) United States Patent
Ishida

(10) Patent No.: US 8,353,588 B2
(45) Date of Patent: Jan. 15, 2013

(54) DRAWING DEVICE

(75) Inventor: Kohei Ishida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 254 days.

(21) Appl. No.: 12/713,477

(22) Filed: Feb. 26, 2010

(65) Prior Publication Data

US 2010/0225720 A1 Sep. 9, 2010

(30) Foreign Application Priority Data

Mar. 4, 2009 (JP) ..... 2009-050790

(51) Int. Cl.
*B41J 2/01* (2006.01)

(52) U.S. Cl. ..... 347/102; 347/9; 347/43; 347/81

(58) Field of Classification Search ..... None
See application file for complete search history.

(56) References Cited

U.S. PATENT DOCUMENTS 6,254,217 B1 * 7/2001 Askeland et al. ..... 347/43
6,786,589 B2 * 9/2004 Suzuki et al. ..... 347/102
6,834,948 B2 * 12/2004 Asano et al. ..... 347/102
7,108,366 B2 * 9/2006 Ishikawa ..... 347/102
7,658,489 B2 * 2/2010 Yamanobe ..... 347/102
7,690,782 B2 * 4/2010 Odell ..... 347/102
2008/0174648 A1 7/2008 Nakano et al.
2008/0198189 A1 * 8/2008 Vanhooydonck et al. ..... 347/9

FOREIGN PATENT DOCUMENTS

JP 2008-188983 A 8/2008

* cited by examiner

*Primary Examiner* — Matthew Luu
*Assistant Examiner* — John P Zimmermann
(74) *Attorney, Agent, or Firm* — Global IP Counselors, LLP

(57) ABSTRACT

A drawing device includes a carriage, a base configured and arranged to mount a substrate, and a movement device configured and arranged to move the substrate and the carriage relative to each other in a first direction and a second direction intersecting the first direction. The carriage includes a plurality of types of droplet ejection head units and a plurality of ink-curing light irradiation sections. The droplet ejection head units are configured and arranged to respectively eject a plurality of types of photo-curing inks onto the substrate with the droplet ejection head units being aligned along a direction intersecting the second direction at a predetermined pitch. The ink-curing light irradiation sections are respectively disposed in positions adjacent to both sides of each of the droplet ejection head units in the second direction, and configured and arranged to cure the photo-curing inks.

15 Claims, 10 Drawing Sheets

DRAWING DEVICE

CROSS-REFERENCE TO RELATED APPLICATIONS

This application claims priority to Japanese Patent Application No. 2009-050790 filed on Mar. 4, 2009. The entire disclosure of Japanese Patent Application No. 2009-050790 is hereby incorporated herein by reference.

BACKGROUND

1. Technical Field

The present invention relates to a drawing device for drawing by ejecting and curing a photo-curing ink.

2. Related Art

Photo-curing ink (UV-curing ink) that is cured by UV irradiation has recently been attracting attention for use in inkjet printers and the like.

The difference between UV-curing ink and regular water-based ink or oil-based ink is that after the UV-curing ink is applied on a substrate (including printing paper or other recording media) or the like, the ink is rapidly cured by irradiation with an appropriate quantity of UV rays.

Such characteristics enable UV-curing ink to produce stable printing quality regardless of the ink permeability and other properties of the substrate.

Curing the ink immediately after it is applied also makes it possible to prevent the ink from spreading out.

Even when ink of a different color is applied over existing ink to create a desired hue, applying the different ink after curing the bottom ink makes it possible to prevent the hue from being affected by co-mixing; i.e., it is possible to prevent the wrong color from being produced.

There has been proposed such an inkjet-type recording device (drawing device) that uses UV-curing ink, in which a UV radiating device is provided for radiating UV rays to ink ejected onto a recording medium (substrate), the UV radiating device being provided on the periphery of a recording head (droplet ejection head) for ejecting a UV-curing ink in the form of minute ink drops (droplets) (see, e.g., Japanese Laid-Open Patent Publication No. 2008-188983). In this recording device, the UV radiating device is provided at both ends of a carriage for reciprocally moving the recording head in the width direction of the recording medium.

SUMMARY

Numerous inkjet-type recording devices (drawing devices) have been used in industrial settings in recent years, and the use thereof in drawing characters, numbers, and various designs on, for example, decorative panels as substrates has also been studied. There is also a need to further improve the color or precision of designs and the like using the abovementioned characteristics of UV-curing ink (photo-curing ink) in particular in drawing designs and the like such as described above.

However, the recording device described in Japanese Laid-Open Patent Publication No. 2008-188983 has drawbacks in that the light sources (UV radiating devices) for irradiating UV rays are provided only at both ends in the movement direction of the carriage to which the recording head is attached; therefore, when a plurality of recording heads (droplet ejection heads) is attached to the carriage for drawing, as in a drawing device for industrial use, it is difficult to cure the ink immediately after the ink is applied on the substrate, and it is impossible to take adequate advantage of the aforementioned characteristics of the UV-curing ink (photo-curing ink).

Particularly when different colors of ink are ejected in order to create various hues in a design or the like, a different droplet ejection head is provided for each color, and each of the heads eject independently. However, when the carriage is reciprocally moved, and the ink is ejected during any of outward and return movement, since the sequence in which the ink is ejected differs between outward movement and homeward movement, the hue of the obtained design or the like differs slightly from the desired hue. Specifically, when different colors of ink are applied over each other to create a desired hue, the hue obtained by layering the inks differs slightly according to the sequence in which the plurality of types of ink is applied.

The present invention was developed in order to overcome the problems described above, it being an object thereof to provide an excellent drawing device whereby the characteristics of a photo-curing ink can be adequately utilized particularly to enable higher precision, and to enable the desired hue of a design or the like as well to be drawn satisfactorily when a plurality of droplet ejection heads is attached to a carriage.

A drawing device according to a first aspect includes a carriage, a base configured and arranged to mount a substrate, and a movement device configured and arranged to move the substrate and the carriage relative to each other in a first direction and a second direction intersecting the first direction. The carriage includes a plurality of types of droplet ejection head units and a plurality of ink-curing light irradiation sections. The droplet ejection head units are configured and arranged to respectively eject a plurality of types of photo-curing inks onto the substrate with the droplet ejection head units being aligned along a direction intersecting the second direction at a predetermined pitch. The ink-curing light irradiation sections are respectively disposed in positions adjacent to both sides of each of the droplet ejection head units in the second direction, and configured and arranged to cure the photo-curing inks.

In this drawing device, since the ink-curing light irradiation sections for curing the photo-curing ink are arranged adjacent to each other on both sides of each of the droplet ejection heads in the second direction with respect to all of the droplet ejection heads in the carriage, when the photo-curing ink is ejected from each of the plurality of droplet ejection heads while the carriage is moved in the second direction, the light radiation sections are disposed so as to follow all of the droplet ejection heads in the movement direction thereof. Consequently, the light radiation sections can immediately be positioned directly over the positions of ejection by moving the carriage after the photo-curing ink has been ejected. Light can thereby be irradiated from the light radiation sections immediately after the ink is ejected, and immediate curing of the ejected ink is possible for all of the droplet ejection heads.

Since a plurality of types of droplet ejection heads for ejecting mutually different photo-curing inks is provided to the carriage and arranged at a predetermined pitch in a direction intersecting the second direction, by making the aforementioned predetermined pitch coincide with the feed pitch when the substrate is conveyed in relative fashion in the first direction, the ejected ink can be drawn using the same overlap sequence (layering sequence) regardless of whether the direction of relative movement of the carriage during ejection is outward or homeward in the second direction.

Specifically, since the aforementioned predetermined pitch coincides with the feed pitch of the substrate, only one droplet ejection head corresponds to and ejects in the region corresponding to one unit of the feed pitch of the substrate. Ink is ejected from the corresponding droplet ejection head onto the previously ejected site after the substrate is fed a predetermined pitch, and the ink overlaps, but there is still only one corresponding droplet ejection head. Consequently, while conveyance of the substrate in the first direction is stopped, only one droplet ejection head corresponds to and ejects in the region corresponding to one unit of the feed pitch. Therefore, regardless of whether the droplet ejection head is moved outward or homeward in the second direction, the overlap always occurs over the ink ejected by the previous droplet ejection head. Drawing can therefore be performed with the overlap sequence (layering sequence) of the ejected ink always corresponding to a sequence that corresponds to the droplet ejection heads arranged in the carriage.

In the drawing device, the ink-curing light irradiation sections are preferably configured and arranged with respect to the droplet ejection head units such that light irradiated by each of the ink-curing light irradiation sections has an optimum curing wavelength of a corresponding one of the photo-curing inks ejected by a corresponding one of the droplet ejection head units.

According to this aspect of the invention, since the ink-curing light irradiation sections radiate light that has a wavelength corresponding to the optimum curing wavelength of the photo-curing ink, the photo-curing ink ejected onto the substrate is more rapidly cured. Moreover, since each of different inks can be rapidly cured, the curing rates are prevented from fluctuating between colors.

In the drawing device, the carriage preferably further includes a pair of surface treatment sections configured and arranged to perform surface treatment of the substrate, the surface treatment sections being respectively arranged on both sides of the ink-curing light irradiation sections arranged on both sides of one of the droplet ejection head units that is placed in a leading position with respect to the substrate among the droplet ejection head units that are aligned along the direction intersecting the second direction.

According to this aspect of the invention, it is possible for, e.g., a surface treatment light to be irradiated first on the substrate by the surface treatment sections and the surface of the substrate to be treated prior to ejection of the photo-curing ink from the droplet ejection heads while the carriage and substrate are moved. Since the surface treatment sections are provided on both sides of the ink-curing light irradiation sections, the surface of the substrate corresponding to the droplet ejection head that is in the leading position with respect to the substrate can be treated in advance for both outward and homeward movement in the second direction.

Each of the surface treatment sections preferably includes a light radiation source configured and arranged to radiate surface treatment light to perform surface treatment of the substrate.

When the surface of the substrate is fluid repellent, for example, the surface of the substrate can be made lyophilic by being irradiated with the surface treatment light, and the wetting properties of the photo-curing ink can be enhanced to increase the drawing quality (printing quality).

Each of the surface treatment sections preferably includes a primer ink ejection head configured and arranged to eject a photo-curing primer ink to perform surface treatment of the substrate, and a light radiation source configured and arranged to radiate light for curing the photo-curing primer ink, the light radiation source being provided adjacent to an inner side of the primer ink ejection head in the second direction.

According to this aspect of the invention, a photo-curing primer ink can be ejected, and the photo-curing primer ink cured before the photo-curing ink is ejected from the droplet ejection head. Consequently, through such a surface treatment, the wetting properties of the photo-curing ink on the substrate surface, for example, can be enhanced, and the drawing quality (printing quality) can be increased.

In the drawing device, each of the ink-curing light irradiation sections preferably has a light-emitting surface positioned at a higher elevation than a nozzle surface of a corresponding one of the droplet ejection head units.

This configuration makes it possible to reliably prevent the light radiated from the light radiation sections from radiating to the nozzles of the droplet ejection head, curing the ink inside the nozzles, and causing the nozzles to become blocked.

In the drawing device, the carriage preferably further includes a cooling section disposed in the vicinity of the ink-curing light irradiation sections.

When, e.g., a light-emitting diode (LED) is used as the light radiation sections, the light radiation sections can be degraded and the service life thereof reduced by the heat thereof or the surrounding heat. Therefore, degradation can be prevented and longer service life can be obtained by providing a cooling section to cool the light-emitting diode (light radiation section).

The drawing device preferably further includes a plurality of tanks connected to the droplet ejection head units via ducts, and configured and arranged to store the photo-curing inks, and a heating unit coupled to at least one of the droplet ejection head units, the ducts, and the tanks configured and arranged to adjust the viscosity of the photo-curing inks.

According to this aspect of the invention, by heating the photo-curing ink and lowering the viscosity thereof with the aid of the heating unit, the fluidity of the photo-curing ink can be increased, and satisfactory ejection properties can be obtained.

In the drawing device, each of the droplet ejection head units preferably includes a plurality of nozzles arranged in a direction intersecting the second direction, and each of the ink-curing light irradiation sections preferably includes a plurality of light sources arranged in the direction intersecting the second direction so that a space between adjacent ones of the light sources corresponds to a space between adjacent ones of the nozzles.

According to this aspect of the invention, it is possible to prevent a situation in which the ink ejected from a nozzle is not adequately irradiated by the light from the light source when the nozzle is in a position between the light sources. Light-emitting diodes are suitable as the light sources in this case.

In the drawing device, each of the droplet ejection head units preferably includes a plurality of droplet ejection heads aligned along the first direction, and configured and arranged to eject the photo-curing ink of the same type.

According to this aspect of the invention, it is possible to increase the area ejected and cured in a single cycle (one scan) in proportion to the number of droplet ejection heads that are arranged in the first direction.

Each of the ink-curing light irradiation sections preferably includes a plurality of light sources arranged in a direction intersecting the second direction so that a space between adjacent ones of the light sources at a prescribed position corresponds to a space between the droplet ejection heads of a corresponding one of the droplet ejection head units.

According to this aspect of the invention, a light source is prevented from contributing only minimally to ink curing and from being unproductive due to being positioned so as to correspond to the area between single heads, in which no nozzles are present. Light-emitting diodes are suitable as the light sources in this case.

In the drawing device, each of the ink-curing light irradiation sections preferably includes at least one type selected from the group consisting of light-emitting diode, laser diode, mercury vapor lamp, metal halide lamp, xenon lamp, and excimer lamp.

The photo-curing ink is thereby rapidly and satisfactorily cured.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
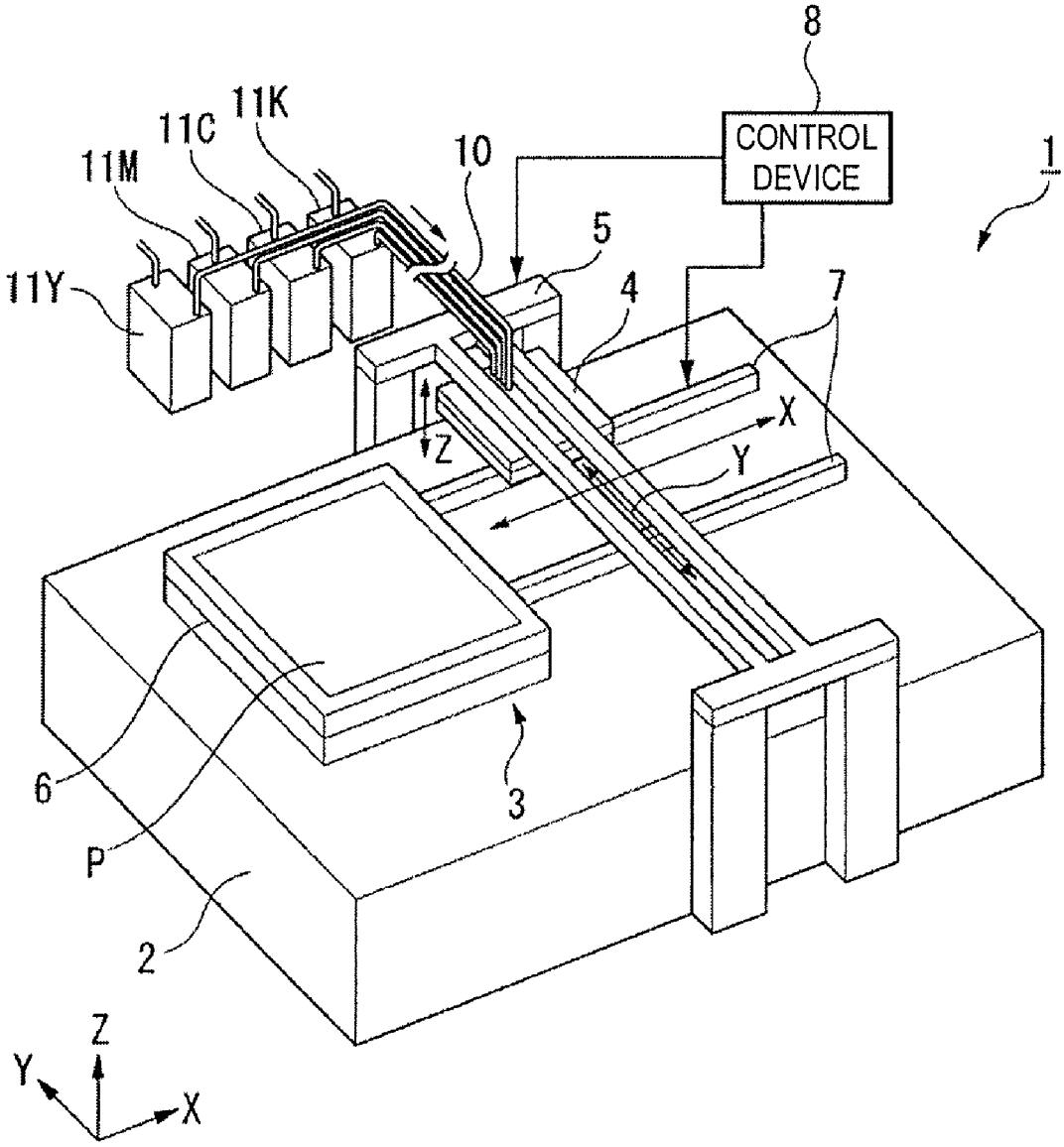
FIG. 1 is a view showing the overall structure of an embodiment of the drawing device of the present invention.

The present invention will be described in detail hereinafter with reference to the accompanying drawings. In the drawings used in the following description, the scale of each member is altered as needed in order to make each member large enough to recognize.

FIG. 1 is a view showing the overall structure of an embodiment of the drawing device of the present invention, and the reference numeral 1 in FIG. 1 refers to the drawing device. The drawing device 1 draws characters, numbers, various designs, or the like on a substrate P by ejecting a photo-curing ink onto the substrate P and radiating light to the ejected photo-curing ink to cure the photo-curing ink.

The drawing device 1 is provided with a base 2 for mounting the substrate P; a conveyance device 3 for conveying the substrate P on the base 2 in the X direction (first direction) in FIG. 1; a droplet ejection head (not shown) for ejecting the photo-curing ink; a carriage 4 provided with a plurality of droplet ejection heads; and a feeding device 5 for moving the carriage 4 in the Y direction (second direction) intersecting the X direction. In the present embodiment, the Y direction is orthogonal to the X direction. In the present embodiment, the conveyance device 3 and the feeding device 5 constitute a moving device of the present invention for moving the substrate P and the carriage 4, respectively, relative to each other in the first direction (X direction) and the second direction (Y direction) orthogonal to the first direction.

The conveyance device 3 is provided with a workpiece stage 6 and a stage moving device 7 that are provided on the base 2. The workpiece stage 6 is provided so as to be able to be moved in the X direction on the base 2 by the stage moving device 7, and the workpiece stage 6 holds the substrate P conveyed from a conveyance device (not shown) upstream on the XY plane with the aid of a vacuum attaching mechanism, for example. The stage moving device 7 is provided with a ball screw, linear guide, or other bearing mechanism, and is configured so as to move the workpiece stage 6 in the X direction on the basis of a stage position control signal inputted from a control device 8 to indicate the X coordinate of the workpiece stage 6.

Figure 2:
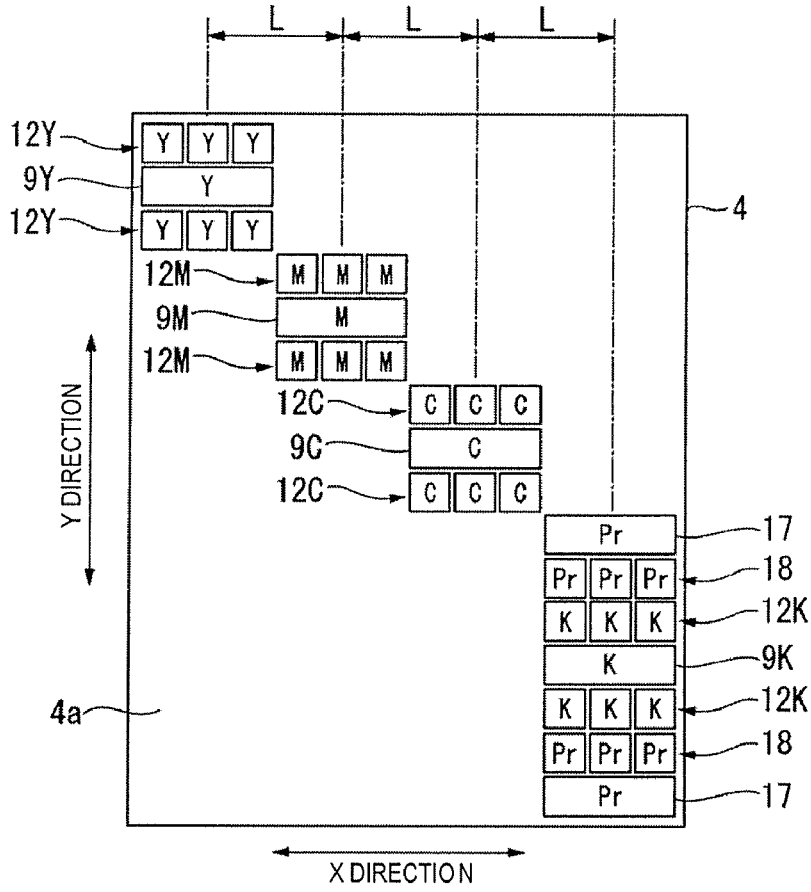
FIG. 2 is a bottom view showing the overall structure of the carriage.
Figure 3:
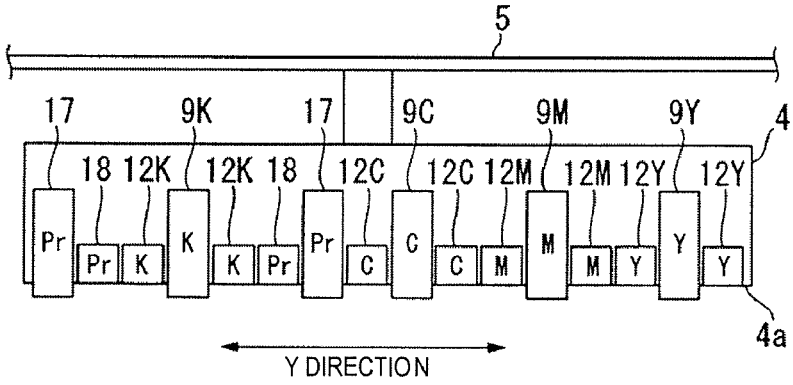
FIG. 3 is a schematic side view showing the overall structure of the carriage.

The carriage 4 is a rectangular plate movably attached to the feeding device 5, and as shown in the bottom view of FIG. 2 and the schematic side view of FIG. 3, a plurality of types (four types in the present embodiment) of droplet ejection heads 9 is arranged in a direction (oblique direction in the present embodiment) intersecting the Y direction (second direction) and retained on the bottom surface 4*a* of the carriage 4. The droplet ejection heads 9 are arranged at a predetermined pitch L in the X direction (first direction) orthogonal to (intersecting with) the Y direction (second direction). The predetermined pitch L coincides with the feed pitch as the substrate P is conveyed in relative fashion in the X direction (first direction) during drawing, as described hereinafter.

The plurality of types of droplet ejection heads 9 (9K, 9C, 9M, 9Y) is provided with numerous (a plurality of) nozzles, as described hereinafter, and eject droplets of photo-curing ink on the basis of drawing data or drive control signals inputted from the control device 8. The droplet ejection heads 9 (9K, 9C, 9M, 9Y) eject photo-curing inks that correspond to K (black), C (cyan), M (magenta), and Y (yellow), respectively, and a tube (duct) 10 is connected to each droplet ejection head 9 via the carriage 4, as shown in FIG. 1.

A first tank 11K in which photo-curing ink for K (black) is filled/stored via a tube 10 is connected to a droplet ejection head 9K that corresponds to K (black), and photo-curing ink for K (black) is thereby fed to the droplet ejection head 9K from the first tank 11K. Likewise, a second tank 11C filled with photo-curing ink for C (cyan) is connected to a droplet ejection head 9C that corresponds to C (cyan), a third tank 11M filled with photo-curing ink for M (magenta) is connected to a droplet ejection head 9M that corresponds to M (magenta), and a fourth tank 11Y filled with photo-curing ink for Y (yellow) is connected to a droplet ejection head 9Y that corresponds to Y (yellow). Through this configuration, the photo-curing ink for C (cyan) is fed to the droplet ejection head 9C from the second tank 11C, the photo-curing ink for M (magenta) is fed to the droplet ejection head 9M from the third tank 11M, and the photo-curing ink for Y (yellow) is fed to the droplet ejection head 9Y from the fourth tank 11Y.

A heater or other heating unit (not shown) is provided for each color (K, C, M, Y) system in the droplet ejection heads 9K, 9C, 9M, 9Y, the tubes (ducts) 10, and the tanks 11K, 11C, 11M, 11Y. Specifically, a heating unit for lowering the viscosity of the photo-curing ink to increase the fluidity thereof is provided to at least one of the droplet ejection head 9, the tube 10, and the tank 11 in each color system, and the photo-curing ink is thereby adjusted so as to be satisfactorily ejected from the droplet ejection heads 9.

The photo-curing ink is a UV-curing ink, for example, or another type of ink that is cured by light at a predetermined wavelength, and includes monomers, a photo-polymerization initiator, and pigments corresponding to each color. The photo-curing ink may also have surfactants, agents for preventing thermal radical polymerization, and various other additives admixed therein as needed. The wavelengths of light (UV rays) absorbed by such a photo-curing ink usually vary according to the components (composition) and other characteristics of the photo-curing ink, and the optimum wavelength for curing; i.e., the optimum curing wavelength, is therefore different for each ink.

Figure 4:
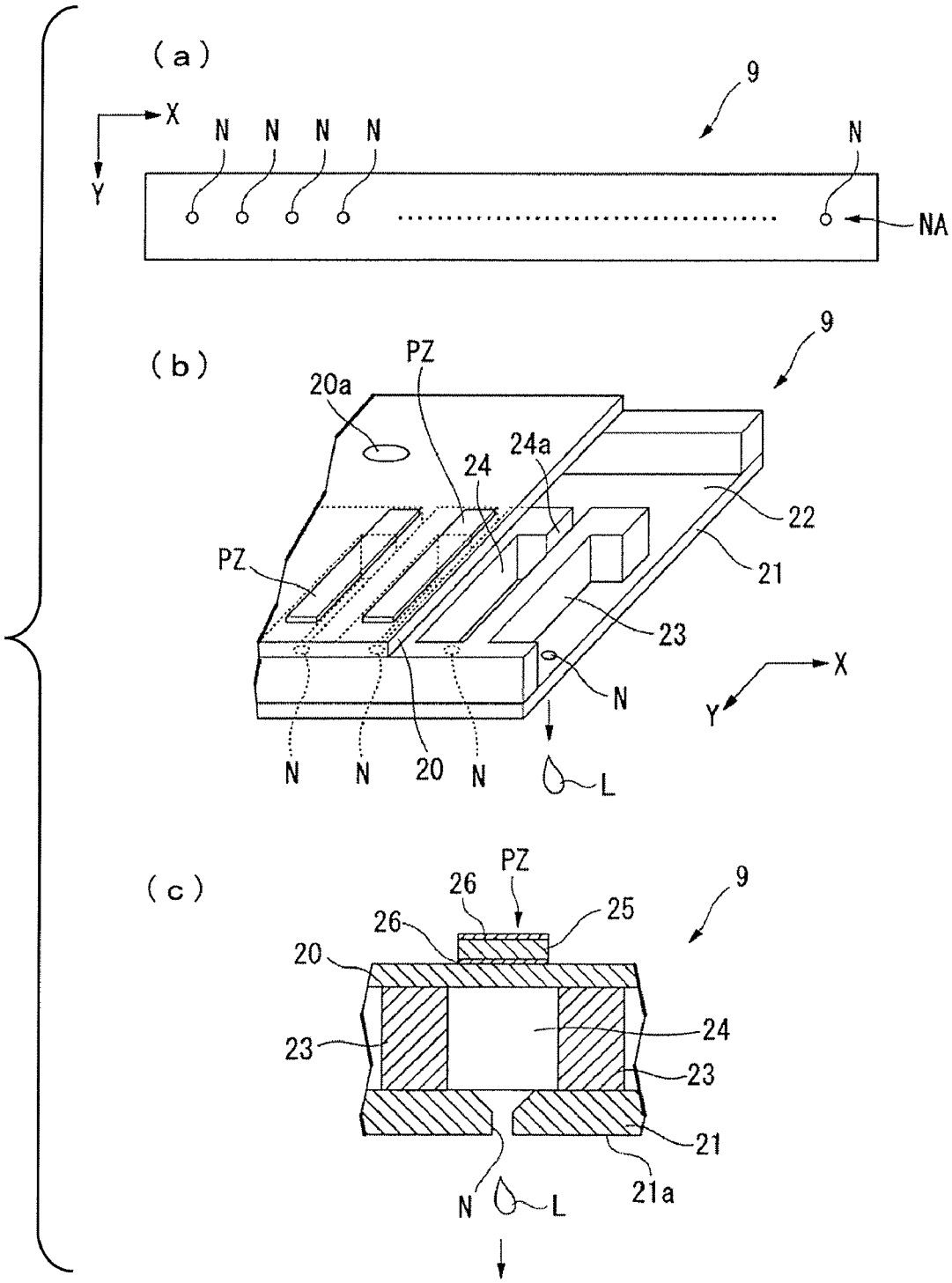
FIGS. 4(*a*) through (*c*) are views showing the overall structure of the droplet ejection head.

In the droplet ejection head 9 as shown in the bottom view thereof in FIG. 4(*a*), a plurality (e.g., 180) of nozzles N is arranged in a direction intersecting the Y direction (second direction), or in the X direction (first direction) in the present embodiment, and a nozzle row NA is formed by the plurality of nozzles N. One row of nozzles is shown in FIG. 4(*a*), but any number of nozzles and nozzle rows may be provided to the droplet ejection head 9, and a plurality of nozzle rows NA oriented in the X direction may be provided in the Y direction, for example.

As shown in the partial perspective view of FIG. 4(*b*), the droplet ejection head 9 is provided with an oscillation plate 20 in which a material feeding hole 20*a* connected to the tube 10 is provided; a nozzle plate 21 in which the nozzles N are provided; a reservoir (liquid reservoir) 22 provided between the oscillation plate 20 and the nozzle plate 21; a plurality of barriers 23; and a plurality of cavities (liquid chambers) 24. A surface (bottom surface) of the nozzle plate 21 is a nozzle surface 21*a* in which a plurality of nozzle N is formed. Piezoelectric elements (drive elements) PZ are arranged on the oscillation plate 20 so as to correspond to the nozzles N. The piezoelectric elements PZ include, e.g., piezo elements.

The reservoir 22 is filled with photo-curing ink that is fed via the material feeding hole 20*a*. The cavities 24 are formed by the oscillation plate 20, the nozzle plate 21, and a pair of barriers 23, and one cavity is provided for each nozzle N. In each cavity 24, photo-curing ink is introduced from the reservoir 22 via a feeding port 24*a* provided between the pair of barriers 23.

As shown in the partial sectional view of FIG. 4(*c*) showing one nozzle portion of the droplet ejection head 9, the piezoelectric element PZ is formed by a piezoelectric material 25 held between a pair of electrodes 26, and applying a drive signal to the pair of electrodes 26 causes the piezoelectric material 25 to contract. The oscillation plate 20 on which such a piezoelectric element PZ is placed therefore flexes outward (away from the cavity 24) at the same time integrally with the piezoelectric element PZ, and the volume of the cavity 24 is thereby increased.

An amount of photo-curing ink corresponding to the increase in volume thereby flows into the cavity 24 from the liquid reservoir 22 via the feeding port 24*a*. When application of the drive signal to the piezoelectric element PZ is then stopped, the piezoelectric element PZ and the oscillation plate 20 both return to their original shape, and the cavity 24 also returns to its original volume. The pressure of the photo-curing ink inside the cavity 24 is thereby increased, and a droplet L of photo-curing ink is ejected toward the substrate P from the nozzle N.

In the droplet ejection head 9 configured as described above, the bottom surface of the nozzle plate 21; i.e., the nozzle N formation surface (nozzle surface) NS, protrudes from the bottom surface 4*a* so as to be further downward than the bottom surface 4*a* of the carriage 4, as shown in the schematic side view of the carriage 4 shown in FIG. 3.

As shown in FIGS. 2 and 3, ink-curing light irradiation sections 12 (12K, 12C, 12M, 12Y) are provided adjacent to each other in the carriage 4 on both sides of each droplet ejection head 9 in the Y direction (second direction) for all of the droplet ejection heads 9 arranged in the direction intersecting the Y direction. The ink-curing light irradiation sections 12 cure the photo-curing ink, and include numerous LEDs (light-emitting diodes) in the present embodiment. However, the ink-curing light irradiation sections 12 are not limited to LEDs in the present invention; e.g., laser diodes (LD), mercury vapor lamps, metal halide lamps, xenon lamps, excimer lamps, or the like may also be used as the ink-curing light irradiation sections 12.

The light radiated by the ink-curing light irradiation sections 12K, 12C, 12M, 12Y including LED elements in the present embodiment has a wavelength that corresponds to the optimum curing wavelength of the photo-curing ink ejected by the corresponding droplet ejection heads 9. In other words, each type of photo-curing ink has a different optimum curing wavelength according to the components (composition) thereof, as previously mentioned, and the ink-curing light irradiation sections 12K, 12C, 12M, 12Y radiate light having the optimum curing wavelength for the corresponding photo-curing ink.

Figure 5:
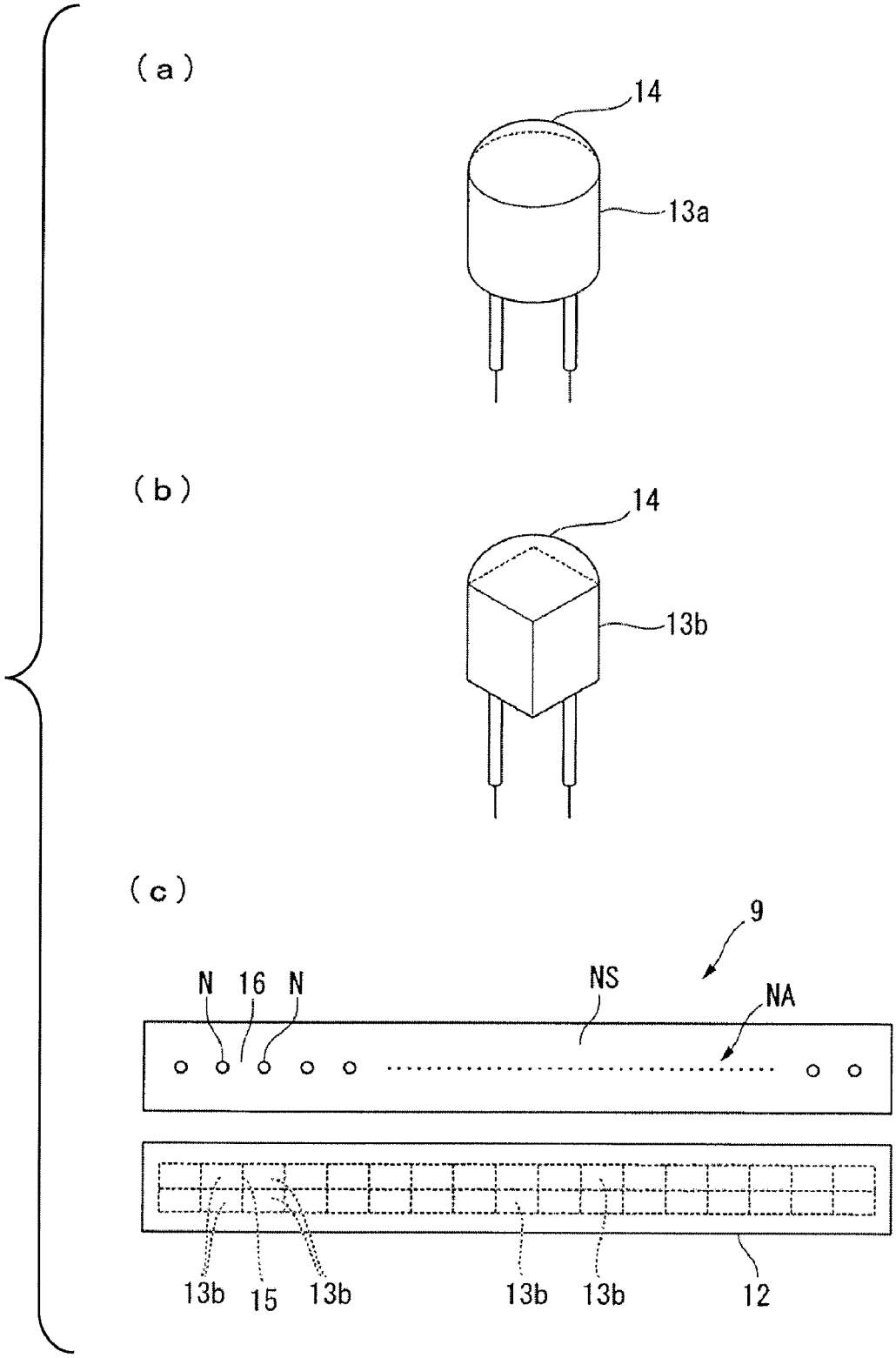
FIGS. 5(*a*) and (*b*) are perspective views showing the light source, and FIG. 5(*c*) is a view showing the light radiation sections.

A commercially available LED light source 13*a*, for example, such as shown in FIG. 5(*a*) is used in the ink-curing light irradiation sections 12, but a light source 13*b* in which the sides of the element body thereof form a rectangle, square, or other polygonal shape such as shown in FIG. 5(*b*) is more suitable for use. Specifically, light sources 13*b* are aligned longitudinally and transversely as shown in FIG. 5(*c*) and attached to the carriage 4 as a single large rectangular light radiation source (ink-curing light irradiation sections 12). Forming each light source 13*b* so as to be square or rectangular in planar view as shown in FIG. 5(*b*) enables the light sources 13*b* to be arranged at a high density in the longitudinal and transverse directions. Consequently, adequately high light output can be obtained from the light radiation source (ink-curing light irradiation sections 12) thus formed.

As shown in FIG. 5(*c*), the ink-curing light irradiation sections 12 is formed by arranging the light sources 13*b* to substantially the same length as that of the nozzle row NA of the corresponding droplet ejection head 9. The light sources 13*b* are arranged so that spaces 15 between pairs of adjacent light sources 13*b* correspond to spaces 16 between pairs of adjacent nozzles N among the plurality of nozzles N. Through this configuration, the light from the light sources 13*b* in the ink-curing light irradiation sections 12 can be reliably irradiated on the photo-curing ink that is ejected from the nozzles N. Specifically, such a configuration makes it possible to prevent a situation in which the ink ejected from a nozzle N is not adequately irradiated by the light from the light sources 13*b* when the nozzle N is in a position that corresponds to a space 15 between the light sources 13*b*.

In FIG. 5(*c*), the nozzles N and the light sources 13*b* are shown as being provided at a 1:1 ratio, but the nozzles N are actually far smaller than the light sources 13*b*, and a single light source 13*b* therefore corresponds to a plurality of nozzles. The spaces 15 between pairs of adjacent light sources 13*b* correspond to the spaces 16 between pairs of adjacent nozzles N in this case as well.

In FIG. 5(*c*), two rows of light sources 13*b* are formed in alignment with the nozzle row NA, but there may also be one row of light sources 13*b*, or three or more rows thereof. Furthermore, FIG. 5(*c*) shows the ink-curing light irradiation sections 12 has having a single group of light sources, but a single ink-curing light irradiation sections 12 may be formed by a plurality of groups of light sources; e.g., as shown in FIG. 2.

The ink-curing light irradiation sections 12 including light sources 13*b* such as described above are attached to the carriage 4 so that the light emission surfaces 14 of the light sources 13*b* shown in FIG. 5(*b*) are substantially flush with the bottom surface 4*a* of the carriage 4, as shown in FIG. 3. The ink-curing light irradiation sections 12 are thereby configured so that the light emission surfaces are positioned at a higher elevation than the nozzle surfaces of the corresponding droplet ejection heads 9. This configuration makes it possible to reliably prevent the light radiated from the ink-curing light irradiation sections 12 from irradiating the nozzles N of the droplet ejection heads 9, curing the ink inside the nozzles N, and causing the nozzles N to become blocked.

As shown in FIGS. 2 and 3, primer ink ejection heads 17 are provided in the carriage 4 on both sides of the droplet ejection head 9 that is placed in the leading position with respect to the substrate P, or on both sides of the droplet ejection head 9K for ejecting photo-curing ink for K (black) in the present embodiment, among the droplet ejection heads 9 arranged in the direction intersecting the Y direction (second direction). The primer ink ejection heads 17 have the same structure as the droplet ejection head 9 shown in FIGS. 4(*a*) through 4(*c*).

Although not shown in FIG. 1, the primer ink ejection heads 17 are connected to tanks (not shown) in which photo-curing primer ink is filled/stored via a tube (not shown) in the same manner as in the droplet ejection heads 9. Primer ink from the tank is thereby fed to the primer ink ejection heads 17.

The primer ink is used to treat the surface of the substrate P, and in the present embodiment, a modification photo-curing ink for lyophilizing the surface of the substrate P and enhancing the wetting properties of the photo-curing ink is used as the primer ink.

Surface treatment light radiation sections (light radiation sources) 18 are provided adjacent to the insides of the primer ink ejection heads 17. These surface treatment light radiation sections 18 are formed by arranging numerous light sources 13*b* including LEDs as shown in FIG. 5(*b*) in the same manner as the ink-curing light irradiation sections 12, and are used to cure the primer ink by radiating light to the primer ink.

The surface treatment light radiation sections 18 are also provided so that the spaces between pairs of adjacent light sources 13*b* correspond to the spaces 16 between pairs of adjacent nozzles N among the plurality of nozzles N in the primer ink ejection heads 17, in the same manner as in the ink-curing light irradiation sections 12. The light from the light sources 13*b* in the surface treatment light radiation sections 18 can thereby be reliably radiated to the primer ink ejected from the nozzles N.

Cooling sections (not shown) are also provided to the carriage 4 in the vicinity of the ink-curing light irradiation sections 12 and the surface treatment light radiation sections 18. The cooling section includes, for example, a structure provided in the carriage 4 for recirculating a coolant fluid, a Peltier element, or another conventionally known cooling section. Providing such a cooling section in the vicinity of the ink-curing light irradiation sections 12 prevents degradation and reduction of service life due to the heat of the LED light sources 13*b* (13*a*) or the surrounding components, and makes it possible to increase the service life of the ink-curing light irradiation sections 12 and the surface treatment light radiation sections 18.

The feeding device 5 for moving the carriage 4 is structured as a bridge over the base 2, for example, and is provided with a ball screw, linear guide, or other bearing mechanism with respect to the Y direction (second direction) and the Z direction (third direction) orthogonal to the XY plane. The feeding device 5 based on such a structure moves the carriage 4 in the Y direction (second direction) as well as the Z direction (third direction) on the basis of a carriage position control signal inputted from the control device 8 that indicates a Y coordinate and Z coordinate of the carriage 4.

The control device 8 outputs the stage position control signal to the stage moving device 7, outputs the carriage position control signal to the feeding device 5, and outputs drawing data and drive control signals to drive circuit boards (not shown) of the primer ink ejection heads 17 and droplet ejection heads 9. The control device 8 thereby synchronously controls the operation for positioning the substrate P by movement of the workpiece stage 6, and the operation for positioning the primer ink ejection heads 17 and droplet ejection head 9 by the movement of the carriage 4, so as to move the substrate P and the carriage 4 relative to each other. The control device 8 also causes droplets of primer ink or photo-curing ink to be arranged in predetermined positions on the substrate P by actuating the ejection of droplets by the primer ink ejection heads 17 and the droplet ejection heads 9.

The control device 8 is also configured so as to actuate light radiation by the surface treatment light radiation sections 18 and the ink-curing light irradiation sections 12 separately from actuating ejection of droplets by the primer ink ejection heads 17 and the droplet ejection heads 9.

When a predetermined design or the like is drawn on the substrate P through the use of a drawing device 1 configured such as described above, the carriage 4 is usually reciprocally moved in relation to the substrate P, and ink is ejected during outward travel as well as homeward travel in order to increase the drawing speed and enhanced productivity. However, in the present invention, ink is ejected using only one type of droplet ejection head 9 (one droplet ejection head 9 in the present embodiment) during outward travel as well as homeward travel with respect to a region of the substrate P having a specific width in the second direction. By gradually feeding this region, ink is ejected from all of the droplet ejection heads 9 in a sequence determined by the arrangement of the droplet ejection heads 9.

In drawing performed by the drawing device 1, the substrate P is first set on the workpiece stage 6. Then, the stage position control signal is outputted to the stage moving device 7 and the carriage position control signal is outputted to the feeding device 5, whereby the substrate P and the carriage 4 are moved relative to each other, and the carriage 4 is placed in a pre-set position in relation to the substrate P.

Specifically, the droplet ejection head 9 that is in the lead position with respect to the substrate P among the heads 9 arranged so as to intersect the Y direction (second direction) in the carriage 4 as shown in FIGS. 2 and 3 is placed in a set position. However, prior to this operation in the present embodiment, the primer ink ejection head 17 on one side among the primer ink ejection heads 17 provided on both sides of the droplet ejection head 9 is positioned directly above a predetermined region E1 of the substrate P, as shown in FIG. 6(*a*).

Figure 6:
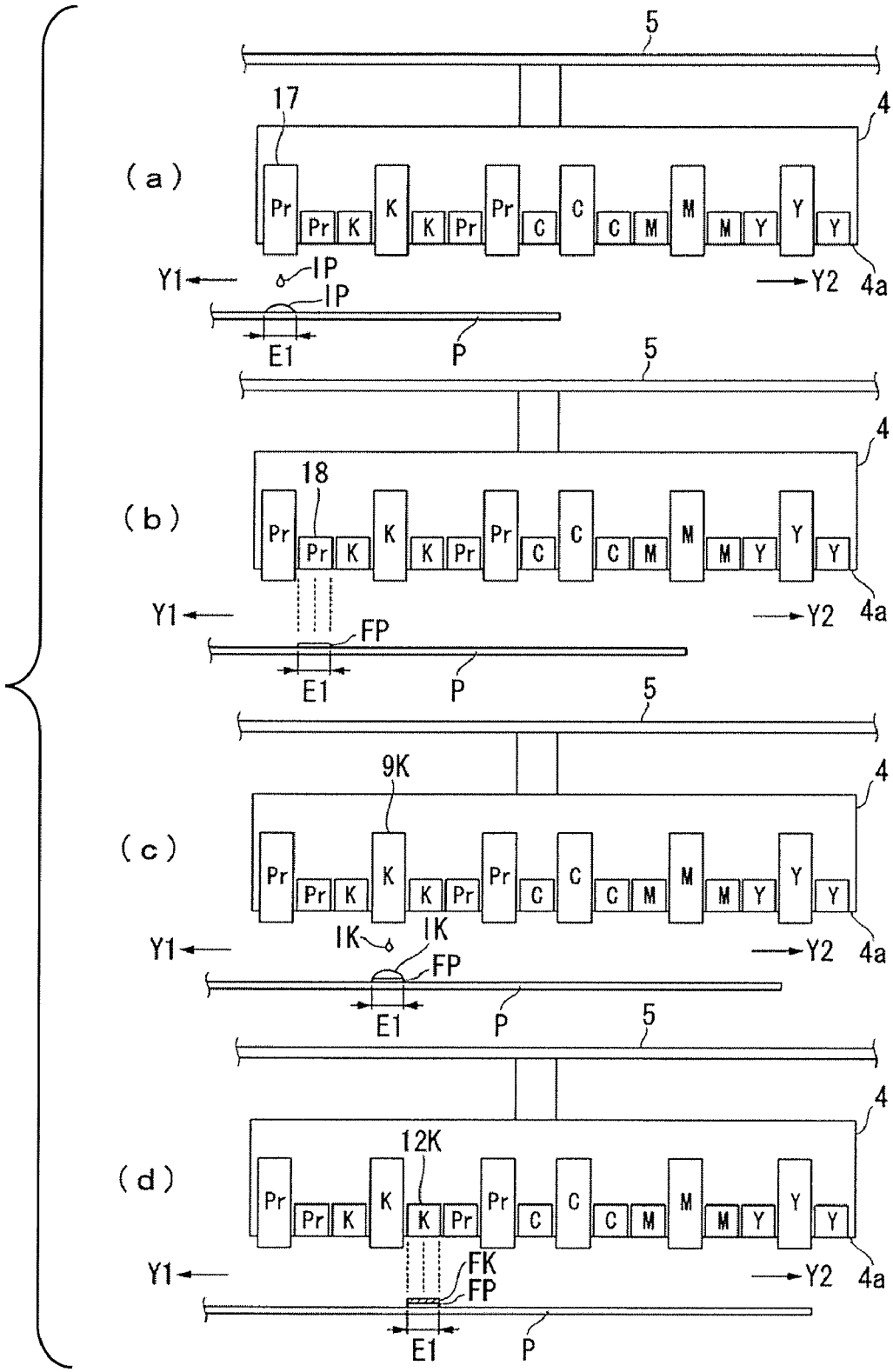
FIGS. 6(*a*) through 6(*d*) are views showing the ink ejection and ink curing steps.

In this arrangement, the carriage 4 is relatively moved outward in the direction indicated by the arrow Y1 in FIG. 6(*a*), and the primer ink ejection head 17 arranged in the direction of the arrow Y1 (to one side in the Y direction) is therefore positioned directly over the predetermined region E1.

Primer ink IP is then ejected from this primer ink ejection head 17, and the desired quantity of ink IP is applied on the predetermined region E1.

The carriage 4 is then moved relative to the substrate P in the arrow Y1 direction, which is the outward direction, and the surface treatment light radiation sections 18 on the other side of the primer ink ejection head 17 in the Y direction (second direction) is positioned directly over the predetermined region E1, as shown in FIG. 6(*b*). Light (UV rays, for example) is then radiated from the surface treatment light radiation sections 18, whereby the primer ink IP applied on the predetermined region E1 is cured, and a thin film FP is formed. Since the primer ink IP is cured immediately after being ejected, the primer ink IP is prevented from spreading. Since the predetermined region E1 is lyophilized by the treatment film FP, the wetting properties of the photo-curing ink on the thin film FP are improved.

The carriage 4 is then moved relative to the substrate P in the arrow Y1 direction, and the droplet ejection head 9K positioned adjacent to the primer ink ejection head 17 from which the primer ink IP was ejected is positioned directly over the predetermined region E1 of the substrate P; i.e., directly over the thin film FP, as shown in FIG. 6(*c*). The photo-curing ink IK corresponding to K (black) is then ejected from the droplet ejection head 9K, and the desired quantity of ink IK is applied on the predetermined region E1. Since the photo-curing ink has satisfactory wetting properties on the thin film FP, the ink IK spreads appropriately on and overlaps the thin film FP.

The carriage 4 is then moved relative to the substrate P in the arrow Y1 direction, and the ink-curing light irradiation sections 12K on the other side of the droplet ejection head 9K in the Y direction (second direction) is positioned directly over the predetermined region E1. Light (UV rays, for example) is then radiated from the ink-curing light irradiation sections 12K, whereby the ink IK applied on the predetermined region E1 is cured, and a thin film FK is formed. Since the ink IK is cured immediately after being ejected, excessive spreading of the ink IK is prevented.

Figure 7:
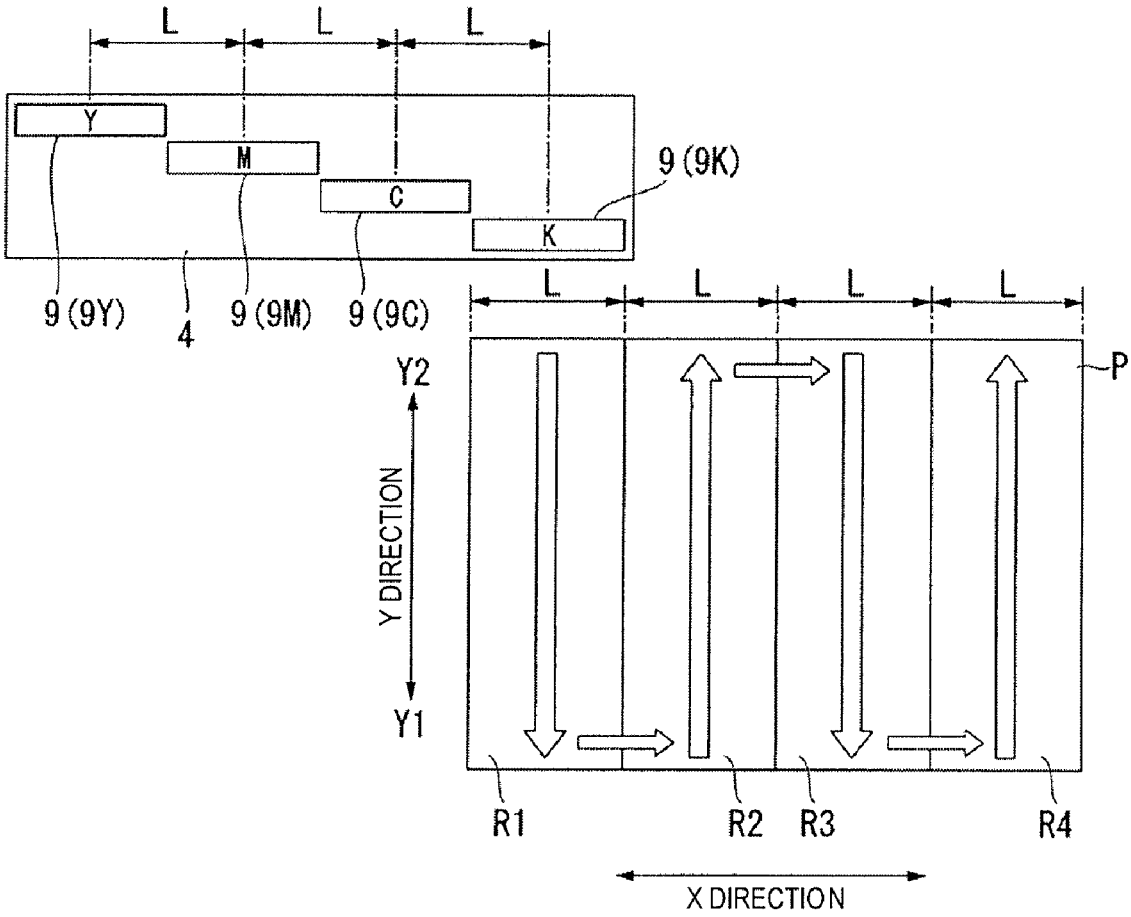
FIG. 7 is a schematic view showing the movement of the carriage relative to the substrate.

The thin film FP composed of primer ink IP and the thin film FK composed of ink IK are layered on each other in sequence in region R1 by repeating the sequence of operations shown in FIGS. 6(*a*) through 6(*d*) while moving the carriage 4 in the outward direction (arrow Y1 direction) relative to region R1 of the substrate P shown in FIG. 7. The primer ink ejection heads 17, the surface treatment light radiation sections 18, and the ink-curing light irradiation sections 12 are not shown in the carriage 4 shown in FIG. 7, and only the droplet ejection heads 9 are shown.

Once formation of the thin film FP and the thin film FK is completed for region R1, the substrate P is conveyed in relative fashion in the X direction (first direction) by an amount commensurate with a feed pitch that coincides with a predetermined pitch in relation to the carriage 4; i.e., the predetermined pitch L between the droplet ejection heads 9 in the X direction. The primer ink ejection heads 17 and the surface treatment light radiation sections 18, and also the droplet ejection head 9K and the ink-curing light irradiation sections 12K are thereby moved in relative fashion to a position that corresponds to region R2 of the substrate P shown in FIG. 7. The droplet ejection head 9C and the ink-curing light irradiation sections 12C positioned next to the droplet ejection head 9K in the X direction (first direction) in the carriage 4 are also moved relatively to the position that corresponds to region R1 of the substrate P.

After the substrate P is moved in this manner, the carriage 4 is moved relative to the substrate P in the arrow Y2 direction, which is the homeward direction. The thin film FP and thin film FK are then layered in sequence by repeating the sequence of operations shown in FIGS. 6(*a*) through 6(*d*) in region R2 of the substrate P. However, the process for the homeward direction differs from the process for the outward direction in that the primer ink ejection head 17 on the side of the arrow Y2 is used, and the surface treatment light radiation sections 18 on the inside of the primer ink ejection head 17 is used; i.e., the surface treatment light radiation sections 18 between the primer ink ejection head 17 and the droplet ejection head 9K is used. The ink-curing light irradiation sections 12K on the side of the droplet ejection head 9K opposite the arrow Y2 side is also used.

Figure 8:
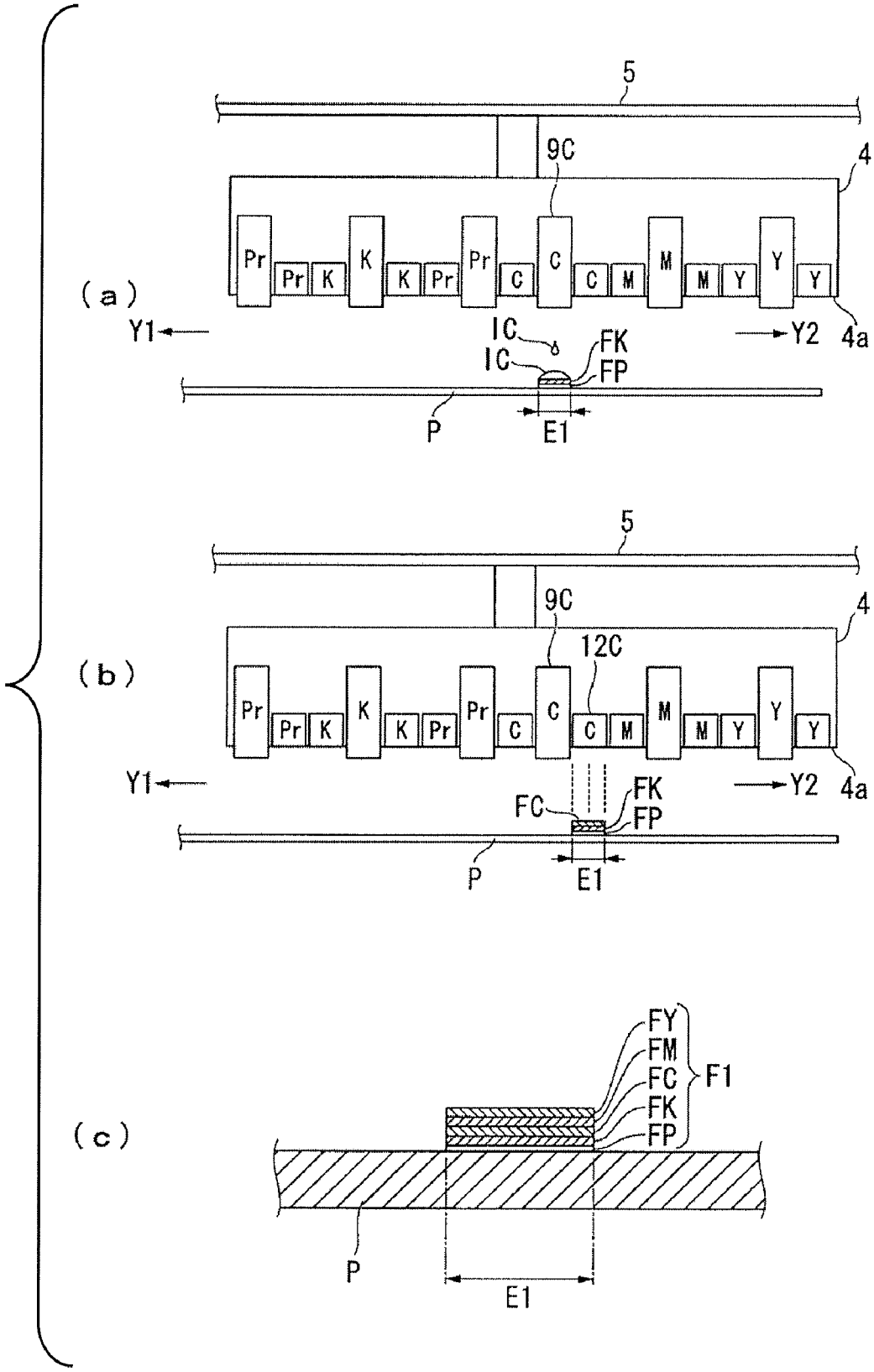
FIGS. 8(*a*) through 8(*c*) are views showing the ink ejection and ink curing steps.

In region R1 of the substrate P, the droplet ejection head 9C is positioned directly over the predetermined region E1 of the substrate P; i.e., directly over the thin film FK, as shown in FIG. 8(*a*). The photo-curing ink IC corresponding to C (cyan) is then ejected from the droplet ejection head 9C, and the desired quantity of ink IC is applied on the thin film FK on the predetermined region E1. Since the thin film FK is already cured, the ink IK of the thin film FK and the ink IC do not mix, and the ink IC overlaps on the thin film FK.

The carriage 4 is then moved relative to the substrate P in the arrow Y2 direction, and the ink-curing light irradiation sections 12C on one side of the droplet ejection head 9C in the Y direction (second direction) is positioned directly over the predetermined region E1; i.e., directly over the ink IC, as shown in FIG. 8(*b*). Light (UV rays, for example) is then radiated from the ink-curing light irradiation sections 12C, whereby the ink IC on the predetermined region E1 is cured, and a thin film FC is formed. Since the ink IC is thus cured immediately after being ejected, it is prevented from spreading and running off the top of the thin film FK, for example.

Ink is thereafter ejected and cured by light radiation while the substrate P is moved in relative fashion one unit of pitch at a time in the X direction, and the carriage 4 is moved in relative fashion in the Y1 direction (outward direction) or the Y2 direction (homeward direction), thereby enabling thin films FP, FK, FC, FM, and FY to be layered in sequence in each predetermined region E of regions R1 through R4.

A layered film F includes thin films FP, FK, FC, FM, and FY layered in sequence as shown in FIG. 8(*c*) can thereby be formed on each predetermined region E of regions R1 through R4. Specifically, since ink is applied in sequence over a thin film that is cured by light radiation, the ink that corresponds to each color can be layered in the desired sequence without mixing, and a layered film F in which each ink is layered at the desired thickness ratio can be obtained without the colors mixing with each other. Since the thin film FP composed of the primer ink IP is formed to lyophilize the predetermined region E1 of the substrate P prior to ejection of photo-curing ink from the droplet ejection heads 9, the wetting properties of the photo-curing ink can be improved even when the surface of the substrate P is fluid repellent.

In the drawing device 1 such as described above, since the ink-curing light irradiation sections 12 for curing the photo-curing ink are provided adjacent to each other on both sides in the Y direction (second direction) of each of the four droplet ejection heads 9, light can be radiated from the ink-curing light irradiation sections 12 immediately after the ink is ejected, and the ink from each of the droplet ejection heads 9 can therefore be cured immediately after being ejected. Even when ejection from the droplet ejection heads 9 is performed during outward movement as well as homeward movement in the Y direction, the ink can be cured immediately after being ejected during outward movement or homeward movement.

Furthermore, since the thin film FP composed of primer ink IP is formed and the predetermined region E of the substrate P is lyophilized before the photo-curing ink is ejected from the droplet ejection heads 9, the wetting properties of the photo-curing ink can be improved even when the surface of the substrate P is fluid repellent.

Since a plurality of types of droplet ejection heads 9 for ejecting mutually different photo-curing inks is provided to the carriage 4 and arranged at a predetermined pitch L in a direction intersecting the Y direction (second direction), by making the predetermined pitch L coincide with the feed pitch of the substrate P, the ejected ink can be drawn using the same overlap sequence (layering sequence) regardless of whether the direction of relative movement of the carriage 4 during ejection is outward or homeward.

Specifically, since the predetermined pitch L coincides with the feed pitch of the substrate P, only one droplet ejection head 9 corresponds to and ejects in the region R corresponding to one unit of the feed pitch of the substrate P. After the substrate is fed a predetermined pitch, ink is ejected from the corresponding droplet ejection head 9 onto the thin film F formed by the previous ejection, and the ink overlaps, but there is still only one corresponding droplet ejection head. Consequently, while conveyance of the substrate P in the X direction (first direction) is stopped, only one droplet ejection head 9 corresponds to and ejects in the region R corresponding to one unit of the feed pitch. Therefore, regardless of whether the droplet ejection head 9 is moved outward or homeward in the Y direction (second direction), the overlap always occurs over the ink ejected by the previous droplet ejection head 9. Drawing can therefore be performed with the overlap sequence (layering sequence) of the ejected ink always corresponding to a sequence that corresponds to the droplet ejection heads 9 arranged in the carriage 4.

Through this drawing device 1, particularly when the carriage 4 is reciprocally moved, the desired hue of a design or the like can be satisfactorily drawn regardless of whether ink is ejected during outward or homeward movement, and the drawing quality (printing quality) can therefore be increased.

The drawing quality can also be increased by lyophilizing the surface of the substrate P to enhance the wetting properties of the photo-curing ink.

Curing the photo-curing ink immediately after ejection thereof also makes it possible to suppress spreading of the ink, and since the other inks are overlapped on cured thin films, different inks can be prevented from mixing. The characteristics of a photo-curing ink can therefore be adequately utilized particularly to enable higher precision, and to enable the desired hue of a design or the like to be obtained.

Figure 9:
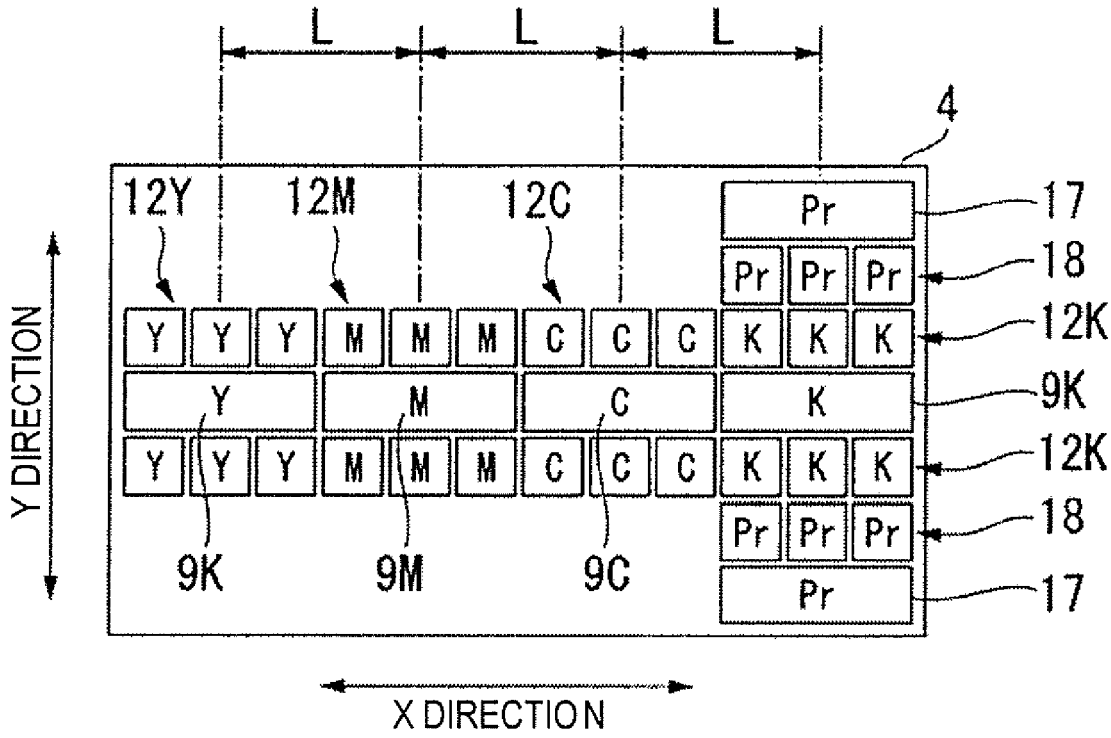
FIG. 9 is a bottom view showing the overall structure of the carriage according to another embodiment of the present invention.

In the embodiment described above, a plurality of types (four types) of droplet ejection heads 9 is arranged on the bottom surface 4*a* of the carriage 4 in a stair-step pattern obliquely intersecting the Y direction (second direction), but this configuration is not provided by way of limitation to the present invention; the droplet ejection heads 9 may also be arranged at a predetermined pitch L in the X direction (first direction), as shown in FIG. 9.

Figure 10:
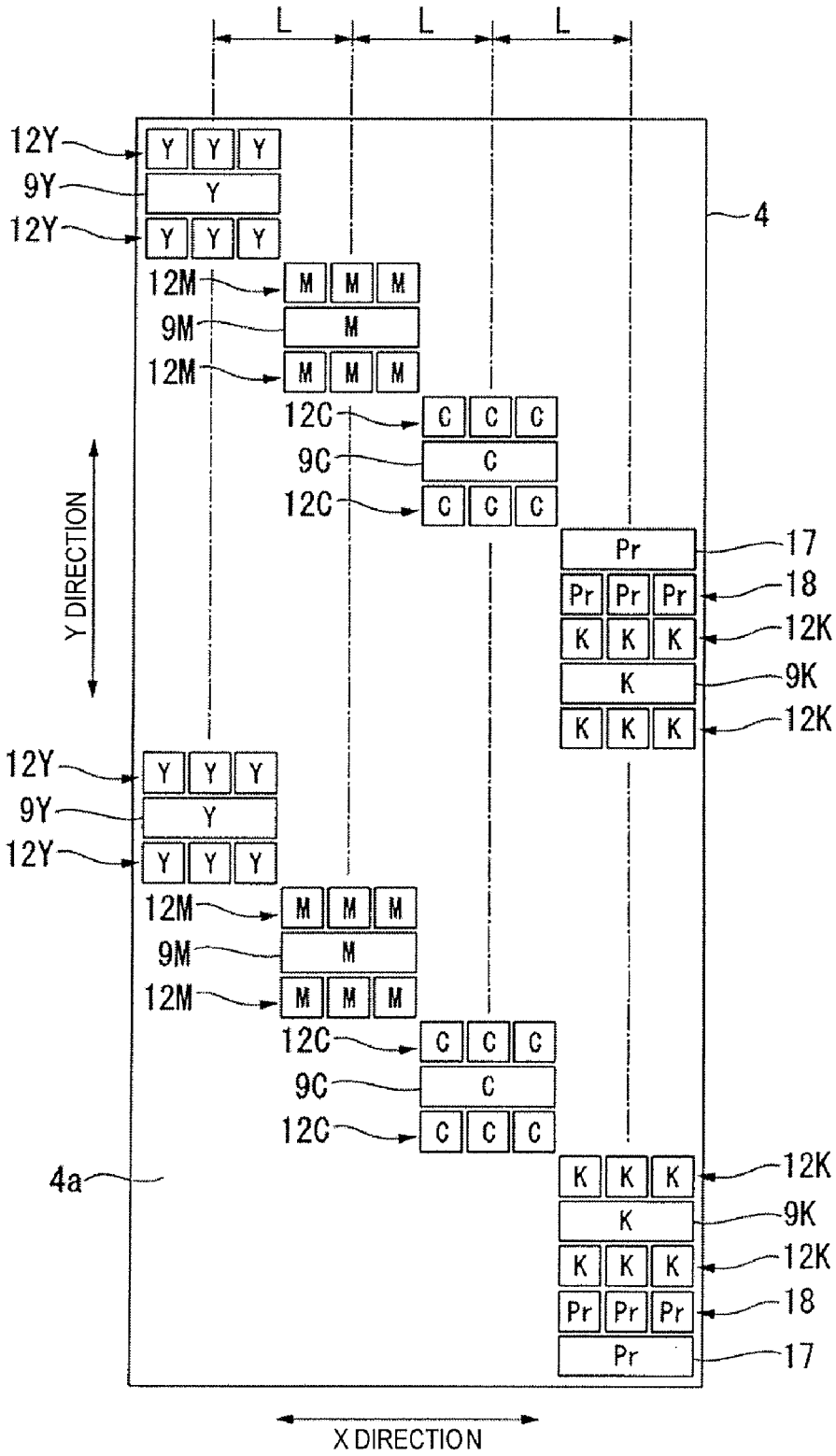
FIG. 10 is a bottom view showing the overall structure of the carriage according to another embodiment of the present invention.

A plurality of each type of droplet ejection head 9 may also be arranged in the Y direction of the carriage 4, as shown in FIG. 10. In this case, a primer ink ejection head 17 is preferably provided on the outside of the ink-curing light irradiation sections 12K that is provided on the outside of each droplet ejection head 9K in the lead position with respect to the substrate P, and the surface treatment light radiation sections 18 is preferably provided on the inside (between the primer ink ejection head 17 and the ink-curing light irradiation sections 12K) of each primer ink ejection head 17.

In the example described above, all four types of droplet ejection heads 9 are used to eject ink during both outward movement and homeward movement in the movement direction of the carriage 4, but ink may, of course, be ejected by the necessary three or fewer heads for regions in which four types of ink are not required.

In this case, the ink-curing light irradiation sections 12 that correspond to droplet ejection heads 9 not used to eject ink are preferably controlled so as not to radiate light. By preventing light from being radiated to positions where ink has not been discharged, the already-formed thin film F can be prevented from being degraded by excessive light irradiation.

Figure 11:
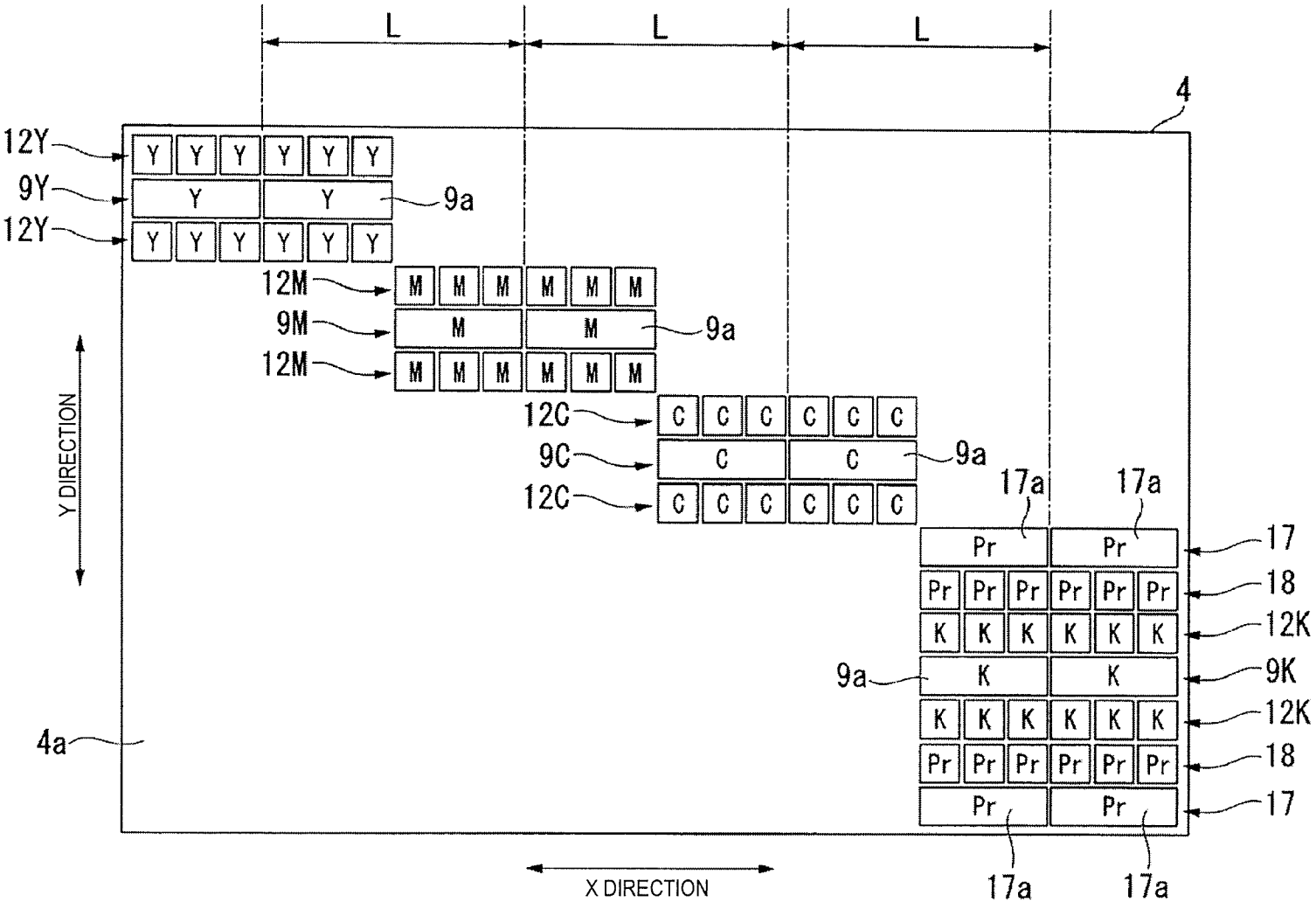
FIG. 11 is a bottom view showing the overall structure of the carriage according to another embodiment of the present invention.

FIG. 11 is a view showing another embodiment of the drawing device of the present invention, and is a bottom view showing the carriage 4. This drawing device differs from the drawing device 1 shown in FIG. 2 and other drawings in that a plurality of single heads 17*a* for ejecting primer ink and single heads 9*a* for ejecting the same type of photo-curing ink is provided to the carriage 4 and arranged in the X direction (first direction), as shown in FIG. 11. A primer ink ejection head 17 is thereby formed from the plurality of single heads 17*a*, and droplet ejection heads 9 are formed from the plurality of single heads 9*a*.

By thus arranging a plurality of primer ink ejection heads 17 and a plurality of droplet ejection heads 9, when ink is ejected while the carriage 4 is moved in the Y direction (second direction), the size of the region R ejected and cured in a single scan cycle (one scan) can be increased in proportion to the number of single heads constituting the ejection heads 9, 17. The efficiency of drawing can therefore be increased, and productivity can be enhanced.

The surface treatment light radiation sections 18 and the ink-curing light irradiation sections 12 in this case must be provided adjacent to the ejection heads 9, 17 and so as to have a length that corresponds to the rows of ejection heads 9, 17. In this configuration, the surface treatment light radiation sections 18 and the ink-curing light irradiation sections 12 are arranged so that the spaces 15 between pairs of adjacent light sources 13*b* in predetermined positions among the plurality of light sources 13*b* shown in FIGS. 5(*b*) and 5(*c*) correspond to spaces between pairs of adjacent heads 9 among the plurality of primer ink ejection heads 17 and droplet ejection heads 9.

Such a configuration of the surface treatment light radiation sections 18 and the ink-curing light irradiation sections 12 prevents a light source 13*b* from contributing only minimally to ink curing and from being unproductive due to being positioned so as to correspond to the area between ejection heads 9, 17, in which no nozzles N are present.

The above embodiments are not provided by way of limitation to the present invention; various modifications may be made within a range that does not depart from the scope of the invention. For example, in the embodiments described above, a primer ink ejection head 17 and a surface treatment light radiation sections 18 for irradiating light to cure the photo-curable primer ink ejected from the primer ink ejection head 17 are provided as means for treating the surface of the substrate P. However, this configuration is not provided by way of limitation to the present invention; particularly in a case in which the surface of the substrate P is modified (e.g., lyophilized) solely by light irradiation, the primer ink ejection head 17 may not be provided, and the surface treatment sections may be formed by only the surface treatment light radiation sections 18.

A configuration may also be adopted in which such a surface treatment light radiation sections 18 is not provided, and only the droplet ejection heads 9 and ink-curing light irradiation sections 12 are provided.

A configuration may also be adopted in which the nozzles N of the droplet ejection heads 9 are divided into groups for each particular region, and one or a plurality of light sources 13*b* in the ink-curing light irradiation sections 12 is made to correspond to each group, for example, and ink ejection and curing by light radiation are thereby controlled for each group of nozzles N rather than for each droplet ejection head 9. Specifically, operation is controlled by the control device 8 so that when ink is ejected from at least one nozzle N of a corresponding group, light is irradiated by the corresponding light source 13*b*, and when ink is not ejected by any of the nozzles N of a corresponding group, no light is radiated by the corresponding light source 13*b*.

Through this configuration, since no light is irradiated on positions in which ink is not ejected, it is possible to prevent the substrate surface from being altered or the thin films F from being degraded by excessive light radiation to the substrate surface or previously formed thin films F.

The movement device of the present invention for moving the substrate P and the carriage 4 relative to each other in the first direction (X direction) and the second direction (Y direction) orthogonal to the first direction, respectively, includes the conveyance device 3 and the feeding device 5 in the embodiment described above. However, the present invention is not limited to this configuration, and the conveyance device 3, for example, may be configured as an XY stage that is capable of moving the substrate P on the base 2 in both the X direction (first direction) and the Y direction (second direction), and the XY stage may be used as the movement device of the present invention.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least +5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A drawing device comprising:

a carriage;

a base configured and arranged to mount a substrate; and a movement device configured and arranged to move the substrate and the carriage relative to each other in a first direction and a second direction intersecting the first direction, the carriage including a plurality of types of droplet ejection head units including a plurality of nozzles, the droplet ejection head units being configured and arranged to eject different colors of photo-curing inks, respectively, onto the substrate with the droplet ejection head units being aligned along an oblique direction to the second direction at a predetermined pitch, and a plurality of ink-curing light irradiation sections respectively disposed in positions adjacent to both sides of each of the droplet ejection head units in the second direction, and configured and arranged to cure the photo-curing inks.

2. The drawing device according to claim 1, wherein the ink-curing light irradiation sections are configured and arranged with respect to the droplet ejection head units such that light irradiated by each of the ink-curing light irradiation sections has an optimum curing wavelength of a corresponding one of the photo-curing inks ejected by a corresponding one of the droplet ejection head units.

3. The drawing device according to claim 1, wherein the carriage further includes a pair of surface treatment sections configured and arranged to perform surface treatment of the substrate, the surface treatment sections being respectively arranged on both sides of the ink-curing light irradiation sections arranged on both sides of one of the droplet ejection head units that is placed in a leading position with respect to the substrate among the droplet ejection head units that are aligned along the oblique direction to the second direction.

4. The drawing device according to claim 3, wherein each of the surface treatment sections includes a light radiation source configured and arranged to radiate surface treatment light to perform surface treatment of the substrate.

5. The drawing device according to claim 3, wherein each of the surface treatment sections includes a primer ink ejection head configured and arranged to eject a photo-curing primer ink to perform surface treatment of the substrate, and a light radiation source configured and arranged to radiate light for curing the photo-curing primer ink, the light radiation source being provided adjacent to an inner side of the primer ink ejection head in the second direction.

6. The drawing device according to claim 1, wherein each of the ink-curing light irradiation sections has a light-emitting surface positioned at a higher elevation than a nozzle surface of a corresponding one of the droplet ejection head units.

7. The drawing device according to claim 1, wherein the carriage further includes a cooling section disposed in the vicinity of the ink-curing light irradiation sections.

8. The drawing device according to claim 1, further comprising a plurality of tanks connected to the droplet ejection head units via ducts, and configured and arranged to store the photo-curing inks, and a heating unit coupled to at least one of the droplet ejection head units, the ducts, and the tanks configured and arranged to adjust the viscosity of the photo-curing inks.

9. The drawing device according to claim 1, wherein the plurality of nozzles are arranged in a direction intersecting the second direction, and each of the ink-curing light irradiation sections includes a plurality of light sources arranged in the direction intersecting the second direction so that a space between adjacent ones of the light sources corresponds to a space between adjacent ones of the nozzles.

10. The drawing device according to claim 1, wherein each of the droplet ejection head units includes a plurality of droplet ejection heads aligned along the first direction, and configured and arranged to eject the photo-curing ink of the same type.

11. The drawing device according to claim 10, wherein each of the ink-curing light irradiation sections includes a plurality of light sources arranged in a direction intersecting the second direction so that a space between adjacent ones of the light sources at a prescribed position corresponds to a space between the droplet ejection heads of a corresponding one of the droplet ejection head units.

12. The drawing device according to claim 1, wherein each of the ink-curing light irradiation sections includes at least one type selected from the group consisting of light-emitting diode, laser diode, mercury vapor lamp, metal halide lamp, xenon lamp, and excimer lamp.

13. The drawing device according to claim 9, wherein each of the light sources includes a light-emitting diode.

14. The drawing device according to claim 1, wherein the droplet ejection head units are aligned along the oblique direction to the second direction at the predetermined pitch so as not to overlap each other as viewed along the second direction and the plurality of nozzles in each of the droplet ejection head units is aligned along the first direction.

15. The drawing device according to claim 1, wherein the plurality of ink-curing light irradiation sections are aligned along the oblique direction to the second direction at the predetermined pitch.

* * * * *